US006862833B1

(12) United States Patent
Gurtner

(10) Patent No.: US 6,862,833 B1
(45) Date of Patent: Mar. 8, 2005

(54) SCOPE-TO-FIREARM ALIGNMENT ASSEMBLY

(76) Inventor: Frederick Wilhelm Gurtner, 1601 Sunfield St., Madison, WI (US) 53704

( * ) Notice: Subject to any disclaimer, the term of this patent is extended or adjusted under 35 U.S.C. 154(b) by 55 days.

(21) Appl. No.: 10/444,647

(22) Filed: May 21, 2003

(51) Int. Cl.[7] ..... F41G 1/38
(52) U.S. Cl. ..... 42/120; 42/129
(58) Field of Search ..... 42/120, 129

(56) References Cited

U.S. PATENT DOCUMENTS

| | | | | | |
|---|---|---|---|---|---|
| 664,927 | A | | 1/1901 | Church | |
| 1,277,932 | A | | 9/1918 | Hollifield | |
| 3,556,666 | A | | 1/1971 | Lichtenstern | |
| 3,744,133 | A | | 7/1973 | Fukusima et al. | |
| 3,908,282 | A | | 9/1975 | Steffan | |
| 4,095,347 | A | * | 6/1978 | Steffan | 42/121 |
| 4,756,111 | A | | 7/1988 | Lapier | |
| 5,005,308 | A | | 4/1991 | Parks | |
| 5,150,528 | A | * | 9/1992 | Shire | 42/129 |
| 5,222,302 | A | | 6/1993 | DeBatty et al. | |
| 5,315,781 | A | | 5/1994 | Beisner | |
| 5,442,860 | A | | 8/1995 | Palmer | |
| 5,499,455 | A | * | 3/1996 | Palmer | 42/120 |
| 5,878,504 | A | | 3/1999 | Harms | |

* cited by examiner

*Primary Examiner*—Michael J. Carone
*Assistant Examiner*—Troy Chambers
(74) *Attorney, Agent, or Firm*—Loyd W. Bonneville

(57) ABSTRACT

An aligning cap is fitted rotationally and coaxially over one of a firearm scope's ends and has pointer-like directional indicator indicia. A set of scope reticulate components—cross-hairs and the like—or a scope alignment reference true to those components—is then brought operably into alignment with the aligning cap's reticulate means and the scope and cap together are re-set into alignment with the firearm bore's center or a firearm alignment so as to eliminate a canted disposition between scope and firearm.

20 Claims, 14 Drawing Sheets

SCOPE-TO-FIREARM ALIGNMENT ASSEMBLY

BACKGROUND OF THE INVENTION

1. Field of the Invention

Firearm Accessories

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term rotable scope emplacement means (4) might be used in one instance but in another, if meaning is otherwise clear from context, expression might be shortened to scope emplacement means (4) or merely means (4). Any of those forms is intended to convey the same meaning.

The term attach or fasten or any of their forms when so used means that the juncture is of a more or less permanent nature, such as might be accomplished by nails, screws, welds or adhesives. Thus it is stated herein that the scope cradle's (217) connection to the firearm body (100) is one of attachment, for which purpose a scope ring bolt (221) is employed. A connection in which one object is easily removed from another is described by the word emplace, as where it is stated herein that the aligning cap (1) is emplaced over one of the scope's ends (213, 214). A connection in which two objects, although not attached could be separated only with considerable difficulty is referred to herein as one of rigid emplacement. The interthreading of the set screws (46) into the threaded apertures (48) to provide for the impingement against a retention spring (47) of a scope (200) comprising diameter too little for the aligning cap (1) to otherwise fit upon (200) is stated herein to be such a connection. Employment of the words connector join or any of their forms is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that historically, many collimating devices, comprised rod-like extensions inserted longitudinally into the firearm barrel (103). The term comprise may also be characterized by what might be considered one-way equivalency, as when it is stated herein that in FIGS. 1 and 22–24, it is the elastic sleeve configuration (41) shown which comprises the necessary rotable scope emplacement means (4), meaning that in the given instance, that object (41) is itself (41) the means (4). This use of the word has a generic sense to it. That is, the elastic sleeve (41) will always be rotable scope emplacement means (4) but such means (4) may be an elastic sleeve (41) in one case but something else in another. However, the word comprise may also be used to describe a feature which is part of the structure or composition of a given object. Thus, the scope cradle, (217) is stated to comprise, among other things, clamping ears (219) as a component thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the object—the firearm or its components in this case—in the manner it would ordinarily be observed if positioned for workbench adjustment or employment in the field. This convention has been adopted as a matter of convenience in discussing orientation and as shown in the drawings, the scope (200) is regarded as being mounted atop the firearm body (100) and the retention spring (47)—employed together with set screws (46) and threaded apertures (48) for impingement purposes when the scope (200) is diametrically too small for the aligning cap (1) to be otherwise fitted onto it (200)—is said to be positioned beneath the scope (200), which becomes seated upon it (47). The use of the terms in this manner must, of course, be interpreted so as to be equally understood regardless of what attitude the assembly is positioned—such as, for example, if it were held upside down for one reason or another.

The term longitudinal refers to generally elongated configuration. Thus, the aligning cap's (1) fit over either the scope's ocular end (213) or its objective one (214)—snug though it is—is stated, nevertheless, to be just loose enough to permit the cap's rotation about the scope's (200) longitudinal axis.

The word coaxial as used herein refers to two structures, one of them positioned upon the end of one off tubular configuration. Both structures comprise a circular dimension, the longitudinal center of the tube-shaped structure disposing an axis there shared in common with the center of the circular object overlying the end. The alignment of the scope's (200) longitudinal axis with the center of the circular aspect of the emplaced cap (1) is, thus, characterized as coaxial.

The term inscribed and the like denote either a drawn, printed or painted rendering, a recessed, grooved or scored detent or one which is embossed. Moreover, the term mark includes all types of inscription.

Certain words have been coined herein to simplify discussion. In some cases, a noun is converted to a verb or adjective. For example, coengage and interthread are terms occasionally applied to describe the relationship of certain threaded objects considered herein which are merely screwed together in some manner. The term rotable or derivations thereof such as rotably are used as a shorthand expression to more conveniently describe operational turning of one object upon another such as the rotable scope emplacement means (4) addressed herein. This convention, perhaps, leans closer to the noun rotor, avoiding expression of the more cumbersome or possibly misleading—and in applicant's view, less communicative—rotatably and the like, which might actually suggest inherent motion of some sort such as that exhibited by a toy top or other spinning object. The term planular refers to the plane-like aspect of a given object's structure. References herein to reticulate means, reticulate components or reticulation refers to sighting indicia including reticles comprising cross-hairs and the like. The word array, as used herein, includes an arrangement comprising as a species thereof but one member of what is potentially a group, in departure from the more popular usage suggesting a plurality is addressed. Such is the case with the externally disposed pointer array (32) comprising certain singularly membered embodiments herein. The meanings of such terms are generally explained ante.

The word multiply is not used herein as a verb, as often otherwise employed, but rather, as an adjective as when the words "doubly" or "triply" are expressed. Thus, it is stated that rotable emplacement means (4) includes as one variation in configuration a multiply slitted tensioned sleeve (42).

A firearm scope (200) is typically mounted atop the firearm body or stock (100) within a scope cradle (217)

attached in turn to the body (100). The scope itself (200) is generally disposed within a scope ring (218) which comprises a pair of clamping ears (219) of size to permit attachment to the cradle (217) by a scope ring securing bolt (221) passing through clamping holes in the ears (219) and a clamping screw slot in the cradle (217). What are typically considered workbench adjustments permit longitudinal rotation of the scope within its ring (218) so that the scope's reticulate components (210)—such as cross-hairs and the like—are oriented to true vertical when the firearm body or stock (100) is so oriented. Expensive adjustment mechanisms permit that to be done with precision. However, in many situations, precise alignment, attempted without benefit of such elaborate equipment, cannot be made because the operator, desiring to align the scope's reticulate components (210) with the firearm bore's center (102) or what is characterized herein as a firearm alignment reference (116) cannot see both those components (210) and the object of alignment simultaneously or even successively with any acceptable degree of continuity. Moreover, it is generally recognized that one cannot even always be sure that firearms delivered from the factory are in proper adjustment—or "in plumb" as some have said. As a result, the planular relationship between the scope's reticulate components (210) and the bore's center (102) is often a canted one—that is, tilted clockwise or counterclockwise as shown in exaggeration for purposes of visualization in FIG. 9 herein. Small deviations from true vertical are known to result in gross targeting errors.

The operator in the field desiring to fire a shot if holding a canted firearm body or stock (100) in true vertical orientation, will observe tilted reticular components (210) when peering through the scope (200) and will attempt to correct the situation by tilting the stock (100), which he holds but does not see, in the direction opposite to that of the tilt or cant. Many scopes (200) even have bubble or other level indicating devices which facilitate that manipulation. To illustrate, peering through the scope of FIG. 9 and observing the scope's vertical and horizontal reticulate components (211, 212, respectively) would suggest that the firearm body (100) and attached scope (200) should be rotated counterclockwise to bring the scope sighting vertical plane (402) to the true vertical or the scope sighting horizontal plane (403) to the true horizontal. That manipulation results in the disposition shown in FIG. 10, in which, although the scope vertical and horizontal planes (402, 403) are true, the firearm body (100) is tilted with reference to true vertical at the cant angle (420) observed for the scope's reticulate components (210) and sighting planes (402, 403) before the manipulating rotation was performed.

It is not always clear to some how a bullet travels over a given distance or why it behaves as it does. One need only recall the illustration of a person dropping an object at the exact instant a bullet is fired horizontally and observing the strange result that both strike the ground—if level—at the same time to conceive of the scientific principles involved. Then, too, it must be acknowledged that gravity is an accelerative force which at any instant increases the bullet's descent at an increasing rate. Gravity is considered to act upon an object at an average rate of about 32 feet per second during each second of descent. But because this is an average, the gravitational acceleration upon a bullet is faster at the end of the first second than it was at the beginning thereof. The same is true for the next second, when the bullet has attained average velocity of about 64 feet per second, and so on. Thus, at the end of a bullet's trajectory (401) it is falling faster than it had been during any previous instant from the time it was fired.

The bullet must be fired upwards—lobbed, as it were, speaking figuratively—for its trajectory (401) to follow an arcuate path which will intersect with the scope sighting line (400) at the designated target (430) range. Pointing the barrel (300) upwards imposes an upward component upon the bullet which partially offsets the gravitational downward component constantly acting upon it. For a more complete illustration, let us suppose that the firearm barrel (103) is pointed upwards but at a little less than the pitch which would allow it to strike the bull's eye of a distant target (430).

As the bullet travels forward, it first passes through a zone designated herein as the proximal trajectory sector (406). At any point within it (406), the bullet is below the scope sighting line (400).

In a short while, the duration of which depends upon the upwards or pitch angle of the barrel (103) with reference to the attitude of the scope (200), the bullet trajectory (401) crosses the scope sighting line (400). That conjunction is herein designated the proximal bullet trajectory and scope sighting horizontal plane intersection point (404).

Then the bullet passes through what is herein designated as the intermediate trajectory sector (408). At any point within it (408), the bullet is above the scope sighting line (400).

Eventually, the passage of time again depending upon the barrel's (300) pitch angle with reference to the scope's (200) attitude, the bullet trajectory (401) again crosses the scope sighting line (400), this time arcing downwards toward the target (430). That conjunction is herein designated the distal bullet trajectory and scope sighting horizontal plane intersection point (407). It is at this point that the bullet would, if the barrel (103) were properly pitched, be expected to strike the bull's eye of the target (430).

In the given circumstances, however, the bullet then passes through what is herein designated as the distal trajectory sector (409). At any point within it (409), the bullet is below the scope sighting line (400).

Finally, the bullet strikes the target (430) substantially below the bull's eye. Were the targets (430) erected at either of the two intersection points (404, 407), the bullet would have struck its (430) bull's eye.

The foregoing illustration, of course, deals only with the point addressed herein, the trajectory (401) of a bullet from a non-canted firearm. It ignores windage, non-level terrain, temperature, humidity, aerodynamic effects upon the bullet and other likely relevant factors as well as terminal velocity due to air resistance. FIGS. 2–8 graphically show the relationships addressed for this non-canted firing example. A smooth curve connecting the impact points (431) of targets (430) interposed along the way as shown would lend itself to interpolating intermediate results.

Because the focus herein is particularly upon firearm canting, however, it is appropriate to present a second illustration.

As the bullet fired from firearm body (100) canted counterclockwise with respect to the scope (200) travels forward and passes through the proximal trajectory sector (406), it is just a little below the scope sighting horizontal plane (403) but has been impelled slightly to the left of the scope sighting vertical plane (402) which is oriented at true vertical with respect to the scope's vertical reticle component (211). The bullet has not dropped quite as far as in the first illustration because by canting the firearm body or stock (100), the operator has actually slightly raised the firearm barrel (103), causing the bullet to initiate its trajectory (401)

from the ever-so-slightly higher level. The amount the barrel (103) has been raised can be determined trigonometrically, from the sine of the cant angle (420).

In keeping with the explanation supra, the bullet trajectory quickly crosses the scope sighting horizontal plane (403) but now, because of the raised initial emission height caused by canting the firearm body (100), it crosses that plane (403) at a point slightly nearer the operator than the proximal bullet trajectory and scope sighting horizontal plane intersection point (404) for a bullet fired from a non-canted firearm. It has also strayed farther to the left. A target situated at the non-canting intersection point (404) might even be struck above the bull's eye depending upon how much initial vertical displacement occurs by attempting to compensate for a given cant angle (420). This is a trivial point, however, since the greatest error in bullet trajectory (401) from canted firing will be in azimuth. In fact, in applying the seemingly corrective counterclockwise canting manipulation, a portion of the bullet's upward impelling angle is lost. After all, if that manipulation were continued all of the way to the scope sighting horizontal plane (403), the pitch angle would be reduced to zero and the trajectory (401) would be that observed merely in horizontal firing, albeit directed away in azimuth.

As the bullet impelled by the canted firing traverses the intermediate trajectory sector (408), it may be only slightly above the scope sighting horizontal plane (403), having failed to attain its intended altitude by reason of the loss of some of the barrel's (103) pitch angle, but it is still progressing leftward along its path (403).

Then, as the bullet trajectory (401) again crosses the scope sighting horizontal plane (403), it does so at a point nearer the operator than the distal bullet trajectory and scope sighting horizontal plane intersection point (407) for a non-canted firearm body (100), tracing out its (401) declining arc toward the target (430). It is at this point that the bullet would, if the barrel (300) were not canted and were properly pitched, be expected to strike the bull's eye of the target (430). Instead, it has reached a point significantly to the left and below the bull's eye.

In the given circumstances, which permit observation of the complete trajectory (401), the bullet then passes through the distal trajectory sector (409), at any point within which (409), it is displaced even farther below the scope sighting horizontal plane (403) and farther left of the bull's eye of the target (430).

Finally, the bullet misses the target (430) altogether, going dramatically downward and to the left. The shot may properly be characterized as having gone "wild". FIGS. 11–15 graphically show the relationships addressed for this canted firing example. As discussed supra, interpolation of intermediate results is feasible.

Scopes (200) were employed in connection with firearms fairly early on. It has even been said that Sir Isaac Newton pioneered the mounting of a scope (200) to a firearm body or stock (100) about 300 years ago. In view of the gravitational concerns discussed supra, this may come as no surprise. In any event, acceptable mechanical means for doing so fairly reliably appears to have emerged more recently in U.S. Pat. No. 4,756,111 issued to Lapier, featuring what is now widely recognized as a characteristic scope mounting base or cradle (217) comprising rings (218), clamping ears (219), securing bolt (221) and clamping holes (220) as familiar parts thereof.

Leveling of the sights, whether of the traditional metal variety—the gun sight—or those inhering in attached scopes (200) had become the center of focus even earlier. This is understandable, of course, since it is generally possible with such leveling devices to view the sighting and leveling mechanisms simultaneously. For instance, U.S. Pat. No. 664,927 issued to Church featured an automatically leveling gunsight such that as the barrel (103) was canted, the sight, weighted in structure, rotated in pendulum fashion to retain vertical orientation. Similarly, U.S. Pat. Nos. 3,908,282 and 4,095,347 issued to Steffan featured a device relying mainly upon weighted or pendulum leveling alignment indicia attached to a rod inserted into the bore (101), the former of the two additionally including an optional cap which, comprising reticulate means, was emplaced upon the scope's ocular end (213), not for independent aligning but for use only in combination with the main alignment indicia. U.S. Pat. No. 5,878,504 issued to Harms included a bubble level. U.S. Pat. No. 3,556,666 issued to Lichtenstern was a device having a bubble level and an interior arrangement of illuminated mirrors and including an eyepiece comprising an elastic sleeve of size to snugly fit the scope's ocular end (213). U.S. Pat. No. 5,005,308 issued to Parks offered an excellent graphic representation highly pertinent to this discussion of the ballistics associated with scope sighting alignment, providing a scope (200) true level indicating device which operated by means of electrical contacts. U.S. Pat. No. 5,315,781 issued to Beisner, featured a bubble level observable simultaneously with the scope's reticulate components (212) to enable making proper alignment.

Leveling devices did not remain the universal answer, however, and that may have been due partly to their complexity and expense. It should be recognized that merely leveling the firearm does not in itself assure that the scope's reticulate components (210) are in alignment with the firearm bore's center (102) as it should be for accurate firing. Field testing is probably the most reliable means of assuring true alignment, since aberrations in structure and alignment as well as a host of other interfering factors not the subject hereof can all be corrected for in response to the test results. In that connection, Harms, supra, proposed vertically slitted viewing indicia disposed atop the firearm barrel (103), through which an externally disposed alignment cue such as the string of a plumb bob. Field testing is not always feasible or practical, however. Some of the innovation has, instead, focused upon scope (200)-to-bore (101) misalignment detection and simple corrective means.

It is not difficult to appreciate the notion that for assured accuracy, the sighting indicia should be aligned with the firearm bore's center (102) since, after all, that is the point from which the bullet emerges. As we have seen, supra, exaggerated shooting errors result from even the smallest canting discrepancies between the scope's reticulate components (210) and the bore (101). Mere leveling cannot alone resolve this problem. We have, in fact, observed that leveling the canted components (210) to bring them into true vertical or horizontal aspect actually produces the error.

It, thus, became acceptable to secure an alignment device within the barrel (103) end. These mechanisms, often characterized as collimating devices, comprised rod-like extensions which were inserted longitudinally into the barrel, thereby fully assuring that the supported indicia would necessarily be aligned directly with the bore's center (102). U.S. Pat. No. 1,277,932 issued to Hollifield, for example, comprised a bull's eye bearing card attached to a tubular projection pushed into the firearm bore (101). The card has cross-hair indicia only on its reverse side where it is concealed from the operator and is employed to check the shooter's aiming technique. U.S. Pat. No. 3,744,133 issued to Fukushima, et al illustrated a scope (200)-to-firearm bore (101) alignment mechanism attached to a spring biased projection thus inserted into the bore (101). The Steffan patents, supra, provided another such example. U.S. Pat. No. 5,222,302 issued to DeBatty, et al presented alignment adopting indicia as part of a device similarly supported within the barrel (103) of a firearm previously brought into alignment by field testing so that the results could be transported—carried away—for comparison with other identical firearms as a military standardization procedure.

However, the notion of penetrating the firearm's bore (101) with any retained and, therefore, potentially abrading instrument is not the most appealing one. Any material soft enough to avoid abrasion or scratching would likely be susceptible to eventual wear and, consequently, prone to bore (101) alignment error. Such must have been the concern which prompted development of the device of the more recent U.S. Pat. Nos. 5,442,860 and 5,499,455 issued to Palmer, which comprised a collimating assembly with sighting indicia including lenses clamped to the firearm body's (100) exterior and supported an extendable linkage framework, the latter of the two patents even enhancing sighting alignment with a projected light beam.

It should not be necessary, however, to actually attach the bore center (102) indicator mechanism to the firearm. One must concede that it should be sufficient merely to provide something which can be emplaced upon one of the the scope's ends (213, 214) a little along the lines of Lichtensterri's sleeved eyepiece or the rearwardly disposed cap Steffan provided for optional use in conjunction with his frontally disposed more elaborate assembly but, by taking these a step or two further, to provide one which instead of merely permitting or confirming such reticulate alignment, also comprises a simple indicator which merely points directly at the bore's center (102) or what is described herein as a firearm alignment reference (116). What is needed, at least for the practically minded, is not a more elaborate expensive alignment assembly but a simple one which can even be carried about in one's pocket when not in use so that it might be conveniently employed not only on the workbench but in the field as well so that if misalignment were suspected to have occurred from transporting or using the firearm, the problem could be addressed on-site and without concern for abrasion or other possible damage to the firearm's bore (101).

In firearms stocks or bodies (100) In which the bore's center (102) is open to view—a bolt action rifle, for example—alignment would be simplified. In most cases, however, the bore (101) is ensconced within the firearm's body (100). The situation with the scope (200) is just as troublesome, perhaps even more so, in that its reticulate components (210) are never viewable except by peering down the scope (200).

It is generally recognized that a centered reference mark of some sort—a printed or painted alignment mark, seam, ridge, groove or other cue of that sort can usually be found upon the scope (200) which, barring any bizarre defect producing discrepancies in manufacture, is disposed in true alignment with scope's reticulate components (210). Similarly, an equally reliable reference mark, seam, ridge, groove and the like can usually be found on the firearm's stock or body (100) which is disposed in vertical alignment with—that is, true to—the firearm bore's center (102). Their presence suggests the possibility of using an independent referencing tool to true up the scope reticle (210) and firearm bore (102) by what is designated herein as referential alignment—that is, indirectly where one or more intermediate reference points are relied upon, as distinguished from directly where they are absent.

If such a referencing tool were configured so that while peering into the scope, it was somehow brought it into alignment with the scope's reticulate components themselves (210)—say, such as by reticulation means of its own—alignment would be properly characterized not as indirect but rather, as direct. Thus, once two such sets of reticulation (2, ante, 210) are mutually aligned and the cap's indicator indicia (3, ante) is pointing at the bore's center (102) or a firearm alignment reference (116), the scope's reticular components (210) are then necessarily aligned with the bore's center (102). It should occur to one, of course, that because viewing up the scope from its objective end (214) results in de-magnification rather than magnification, direct scope reticulate component (210) alignment is really convenient only when undertaken from the scope's ocular end (213). However, the coaxial placement of such a referencing tool upon the scope's objective end (214) could, nevertheless, be useful in conducting indirect alignment.

Since reticulate components—cross-hairs and the like—comprise an inherent linear aspect capable of being brought to the vertical or horizontal in use, an inherently aligned mark (216) on the scope (200) need only be a simple dot. When turned to point to the mark (216), a referencing tool positioned coaxially upon either of the scope's ends (213, 214) necessarily becomes aligned with the reticulate components (210) inside. Such an alignment cue is herein designated a scope alignment reference (216).

However, the situation is different with the firearm's body (100). Were the reference mark merely a point or dot, turning such a referencing tool to point to it would not assure alignment with the firearm bore's center (102). To explain, we know according to Euclidian geometry that any two points define a straight line connecting them. However, the line between the referencing tool and the point or dot on the firearm stock (100) does not necessarily coincide with the one between the dot and the bore's center (102). This is demonstrated in FIGS. 18–20. A mere singular dot on the firearm's stock (100) could only be relied upon if the stock (100) were positioned in plumb—that is, true to the vertical-during the alignment manipulation. But since we cannot be sure without the aid of a bubble level or the like that the firearm's body (100) is properly positioned with reference to the vertical, the inherently aligned mark (116) on the firearm's body (100), must be more than a simple dot. It must instead be configured as a line. If there were two such dots, the line connecting them could serve as the required alignment line.

Fortunately, such marks are provided on the firearm's body (100) in the way of seams, ridges and such. A referencing tool can be positioned in only one way to point along the linear aspect thereof and when turned to point in alignment with that line, it necessarily becomes aligned with the bore's center (102). Because of the directional aspect such an alignment cue comprises, it is preferable a firearm alignment reference (116) be linear in disposition.

It would, of course, be helpful if manufacturers assured the presence of such marks (116, 216) in both instances. Should they have failed to do so, it is entirely feasible for an operator to carefully mark the scope (200) or firearm body (100).

It would be natural to ask, for instance, why the scope's reticulate components (210) could not be aligned with the firearm bore's center (102) merely by observing the linear relationship between the firearm's alignment reference (116)—linear in configuration—and the scope alignment reference (216). The answer is that the two (116, 216) are too widely separated to do so accurately. A distance of about an inch-and-a-half typically separates them (116, 216). However, the interposition of a suitable reference tool between them would shorten that gap.

What must be understood, however, is that in order to make the scope's reticulate components (210) and the bore center (102) true with one another, alignments must be performed in both directions. Moreover, it may be feasible that the alignment with such a referencing tool to the bore's center (102) may be direct, nevertheless, requiring that its alignment with the scope's reticulate components (210) be referential—or the converse, that alignment with the tool to the scope's reticulate components (210) may be direct while that undertaken to the bore's center (102) is referential.

Unfortunately, there is at present, no tool which can be conveniently and satisfactorily applied to either direct and indirect alignment.

It is conceivable that embodiments of the invention might be acceptable which permit either direct or referential alignment with the bore's center (102), depending upon the particular firearm body (100) involved—bolt action or otherwise—and yet, which limit alignment with the scope's reticulate components (210) to that which is referential. However, slightly more elaborate models permitting alignment with the scope's reticulate means (210) directly would be preferred.

As suggested, supra, it would be beneficial if the sort of tool alluded to could be fitted to either of the scope's ends—the ocular (213) and the objective (214). Recognizing that the diameters of the respective ends (213, 214) often differ from one another, not to mention that there are scopes of different diametric size on the market, it would also be helpful if the tool comprised size adjustment capabilities. Such a tool might be shaped in various ways for the connection. Scope end (213, 214) diametric standardization in manufacture would, of course, make such adjustment means unnecessary. Most, if not all, scopes (200), moreover, have interior threaded sectors at their ends (213, 214). To facilitate a tool's emplacement upon the scope (200), it would also be useful if manufacturers assured such to be the case. In those apparently rare instances in which threads are absent from a manufactured scope (200), retrofitting it (200) with either internal or external threads is, of course, always plausible.

The needs and objectives pointed out supra thus far remain only partly addressed in the prior art. Some, such as those just immediately addressed, have not been met at all.

SUMMARY OF THE INVENTION

The invention is a scope-to-firearm alignment assembly featuring an aligning cap (1) comprising indicator or pointing (3) capabilities and scope (200) emplacement (4) properties. Preferably, the cap (1) comprises means of inherent reticulation (2) as well which are in alignment with the indicator indicia (3). Fitted to one of a firearm scope's ends (213, 214), the cap (1) is rotated upon it (213, 214) so as to bring the scope (200) into alignment with itself (1). The scope (200) is loosened from its mount and it (200) and the cap (1) together are then rotated in an axially longitudinal sense until the scope's sights—its reticulation components (210)—become lined up with the firearm bore's axial center (102).

If the bore (101) is open to view such as with a bolt action rifle, alignment to the firearm bore's center (102) is said to be accomplished directly. Although the bore's center (102) is only open to view in a few circumstances, the same alignment can be accomplished by causing the cap's indicator indicia (3)—to point to a firearm alignment reference (116) such as a seam or ridge in the firearm body (100) known to be in alignment with the bore's center (102). This is an indirect, or referential, alignment procedure.

Indirect—or referential—alignment to the scope (200) may also be accomplished between the cap's indicator indicia (3) and a scope alignment reference (216), if present as it often is. Thus, the entire alignment task may be undertaken without even looking into the scope (200), involving two-way indirect alignment, as it were.

If the cap (1) additionally comprises reticulation means—cross-hairs and the like—its (1) alignment with the scope's reticulation (210) can, of course, be accomplished directly by peering down the scope (200).

The cap (1) may be fashioned so that its indicator indicia (3) also serves as the reticulation means (2) by which one lines up the scope (200) with the cap (1). This is accomplished by configuring the indicia (3) as a linear viewing slit (24), for example.

The cap's reticular means (2) may take one of several plausible forms—viewing slits (24), cross-hairs of wire-like solid strands (21), a series of tiny aligned apertures (28) or circumferentially arranged cues (23).

Similarly, the cap's directional indicator indicia (3) might merely be a simple inscription (31)—a line, groove or embossment, for example—of it might be a circumferential reticulation array (32).

Any of several connection mechanisms are feasible, such as the preferred elastic sleeve (41), a multiply slitted tensioned fitting or sleeve (42), tensioned projecting fingers (43) or threads (44) disposed for coengagement with mated threads on either of the scope's ends (213, 214).

To overcome the problem that the opposing scope ends (213, 214) may be of different diametric size and that there are such differences even between scopes (200)—both of those comprising examples of diametric disparity—a mechanism is included by which set screws (46) may be adjusted to secure a scope (200) otherwise too small for the cap (1).

A reliable method of aligning a scope's reticulate components (210) either directly or indirectly to a firearm bore's center (102) to correct a canted disposition is also disclosed. In short, one branch of the procedure requires first aligning the scope's reticulation (210) to the cap's reticulate means (2). Another of the method's branches permits as a first step indirect alignment of the indicator indicia (3) of the coaxially emplaced cap (1) to the scope's reticulate components (210) by aligning merely to a scope alignment reference (216). Both are steps preliminary to aligning the scope (200) together with the cap (1) to the firearm's objects of alignment.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

In FIG. 9, the scope sighting horizontal plane (402) and, accordingly, the scope's reticular components (210), are tilted to the cant angle (420) so that, although the firearm body or stock (100) is itself (100) oriented to the true vertical, the scope's vertical reticulate component (211) is out of alignment with the firearm bore's center (102). FIG. 10 illustrates the position of the firearm body (100) and scope (200) following the operator's seemingly corrective counterclockwise tilting of the body (100) for shooting to orient the scope's reticular components (210) with true vertical and horizontal.

FIG. 21 illustrates, at the scope's objective end (214) in this case, an indicator inscription (31) which can not provide reticulate means (2) because of the cap's (1) opaqueness. FIG. 22 features a viewing aperture (12) through which the scope's alignment reference (216) is visible. FIG. 23 comprises a singularly membered externally disposed pointer array (32) which is shown in alignment with embossed indicia on the scope's end ocular end (213) much in the way of a medicine bottle safety cap.

In FIG. 24, the cap (1) comprises transparent composition (11) so that the scope's reference (216), disposed on the scope's objective end (214) in this case, is visible and shown in alignment with the cap's inscription (31).

FIGS. 39 and 40 depict solid strand reticulate means (21); FIG. 41, circumferential sighting cues (23); and FIGS. 42–44, open aligned apertures (28), the first of these comprising an orthogonal reference (20), the others, singular orientation references (22), one vertically disposed; the other, horizontally so.

In FIG. 52, for example, the adjustment means is shown accommodating a diameter smaller than that of FIG. 53. As explained herein, ante, even these models can be made to comprise variations of rotable scope emplacement means (4).

DESCRIPTION OF THE PREFERRED EMBODIMENT

Figure 1:
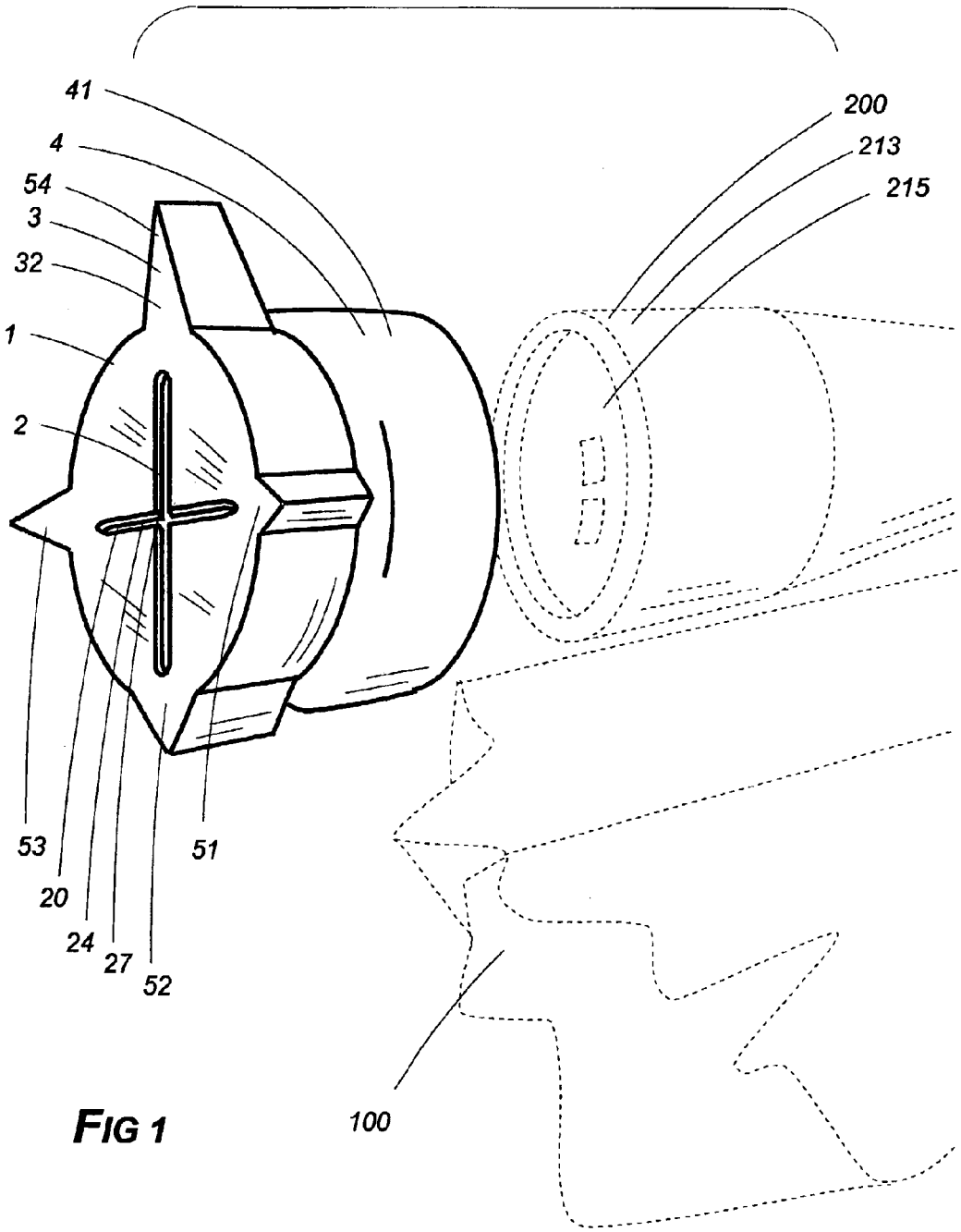
FIG. 1 represents an embodiment of the invention in perspective, the aligning cap (1) having as directional indicia (3) a pointer array (32) of four externally disposed alignment pointing indexes (51–54) arranged in clockwise series from shortest (51) to longest (54) and, for alignment sighting, reticulate means (2) in the form of viewing slits (24) disposed as an orthogonal reference (20). In this showing, the cap's rotable emplacement means (4) is an elastic sleeve (41) which fits snugly over the firearm scope's ocular end (213). With this particular one (1), an operator, after first peering through the slits (24) to line them (24) up with the scope's reticulate components (210), rotates the scope and cap together (200, 1) to align the pointer array (32) with the firearm bore's center (102) if exposed to view or, if not, with a firearm alignment reference (216).
Figure 2:
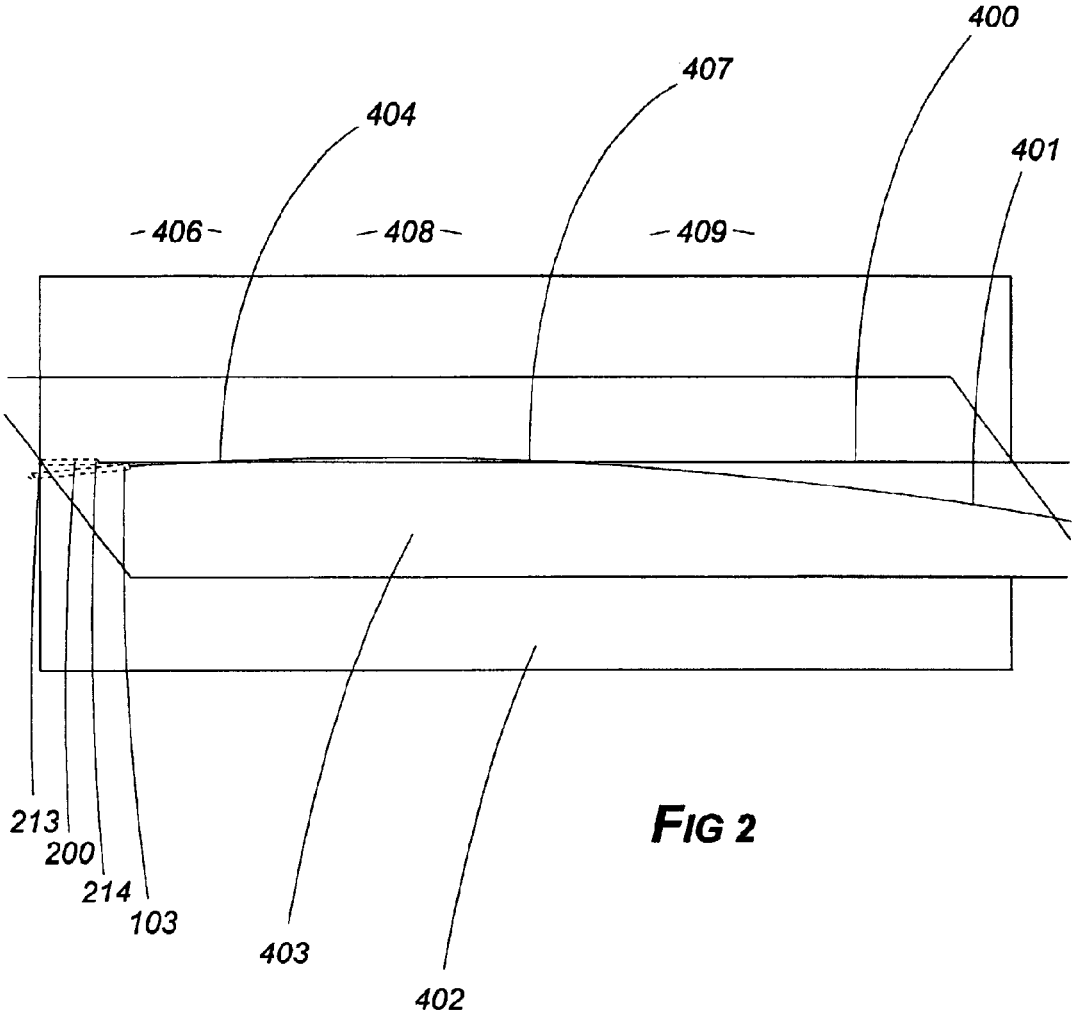
FIG. 2 and comprise perspective side views of the bullet trajectory (401) with reference to the scope sighting horizontal and vertical planes (402, 403, respectively) as it (401) extends through the successive proximal, intermediate and distal trajectory sectors (406, 408, 409, respectively). To enhance visualization, the planes (402, 403) are shown transparently in FIG. 2 but opaquely in FIG. 8.
Figure 3:
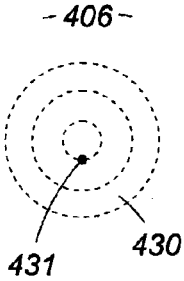
FIGS. 3–7 illustrate the impact points (431) upon targets (430) successively situated for demonstration purposes along the trajectory (401) of a bullet fired from a firearm barrel (100) oriented so that no cant angle (420) of the firearm bore's center (302) and scope sighting line (400) with reference to true vertical is present. The five respective target sites are: Any point within the proximal trajectory sector (406); the proximal trajectory and scope sighting horizontal plane intersection point (404); any point within the intermediate trajectory sector (408); the distal trajectory and scope sighting horizontal plane intersection point (407); and the distal trajectory sector (409).
Figure 4:
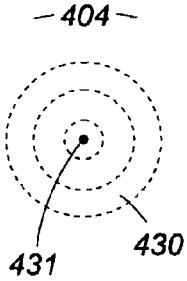
Figure 5:
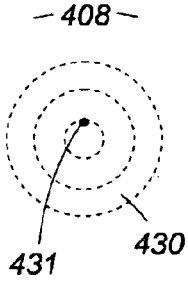
Figure 6:
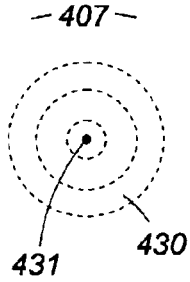
Figure 7:
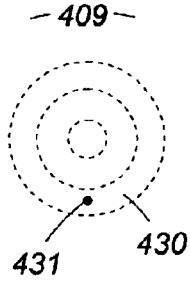
Figure 8:
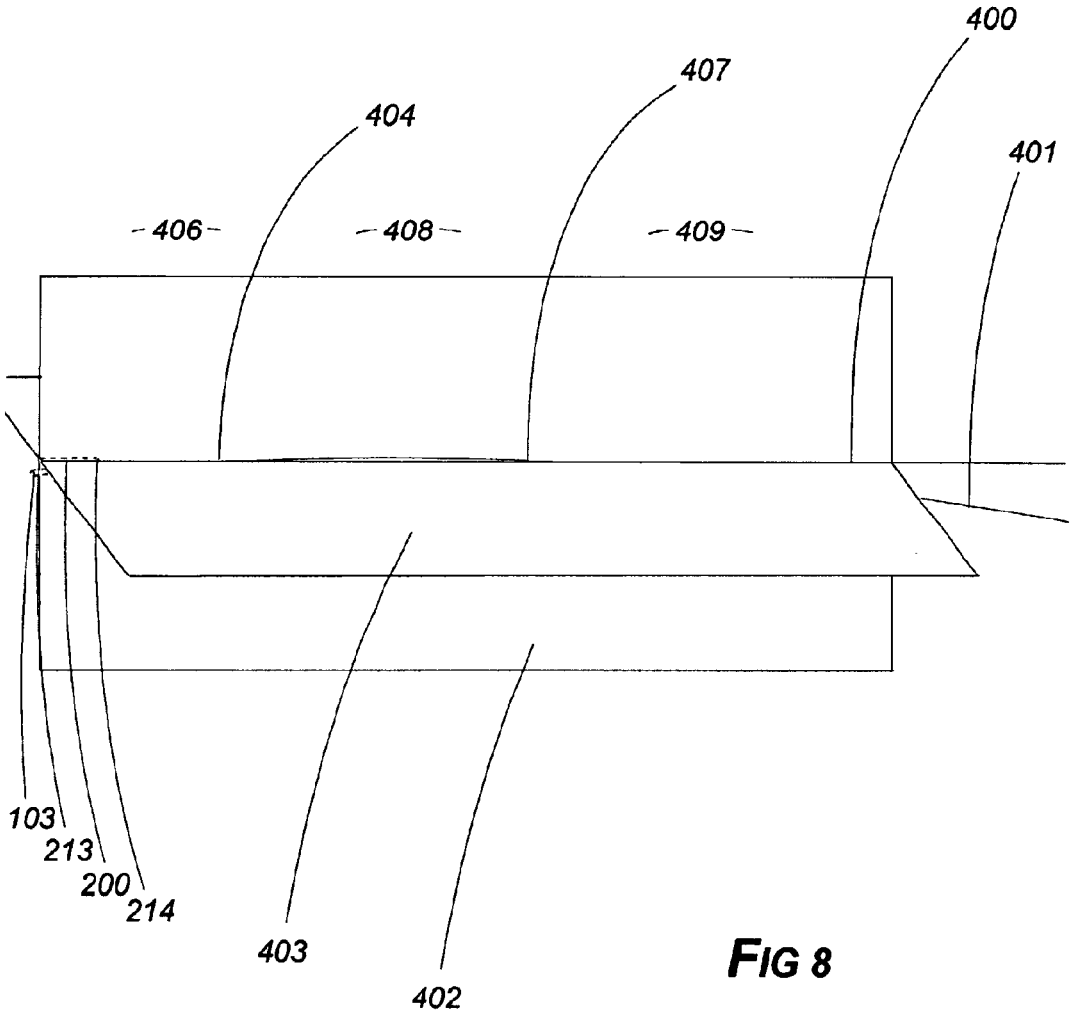
Figure 9:
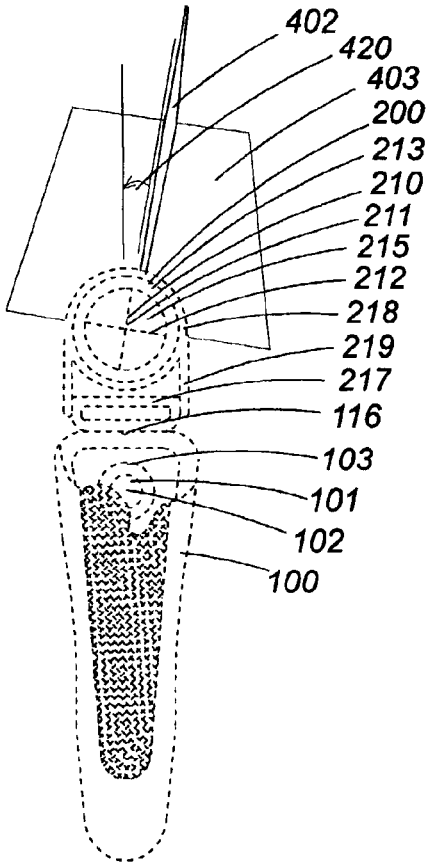
FIGS. 9 and 10 depict from the rear a firearm oriented with its bore's center (102) and scope sighting line (400) disposed at a clockwise cant angle (420).
Figure 10:
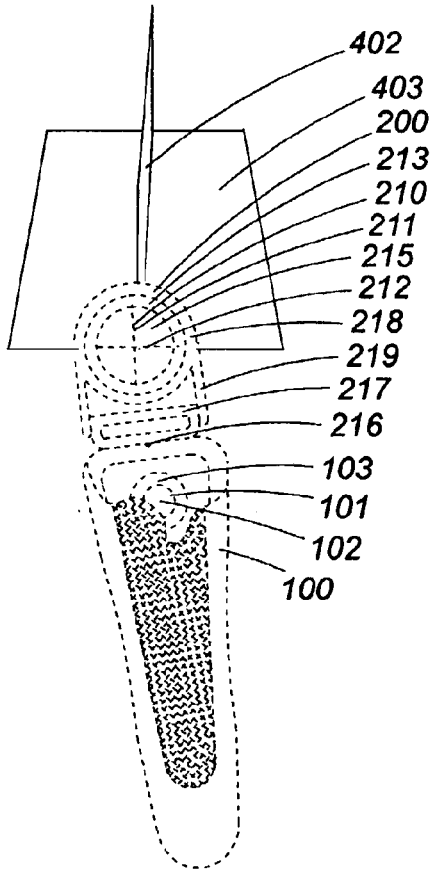
Figure 11:
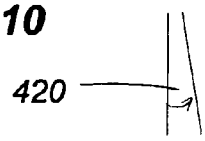
FIGS. 11–15 illustrate the impact points (431) upon targets (430) successively situated for demonstration purposes along the trajectory (401) of a bullet fired from a firearm barrel (103) oriented so that a counterclockwise cant angle (420) of the firearm bore's center (102) and scope sighting line (400) with reference to true vertical is present. The five respective target sites are: Any point within the proximal trajectory sector (406); the proximal trajectory and scope sighting horizontal plane intersection point (404); any point within the intermediate trajectory sector (408); the distal trajectory and scope sighting horizontal plane intersection point (407); and the distal trajectory sector (409).
Figure 11:
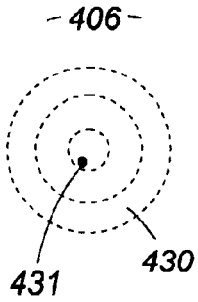
Figure 12:
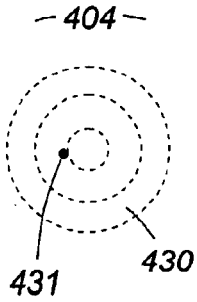
Figure 13:
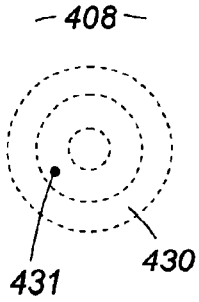
Figure 14:
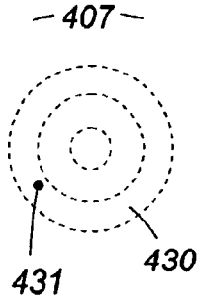
Figure 15:
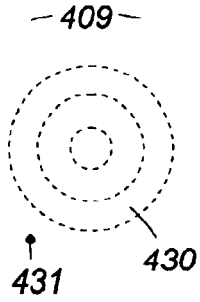
Figure 16:
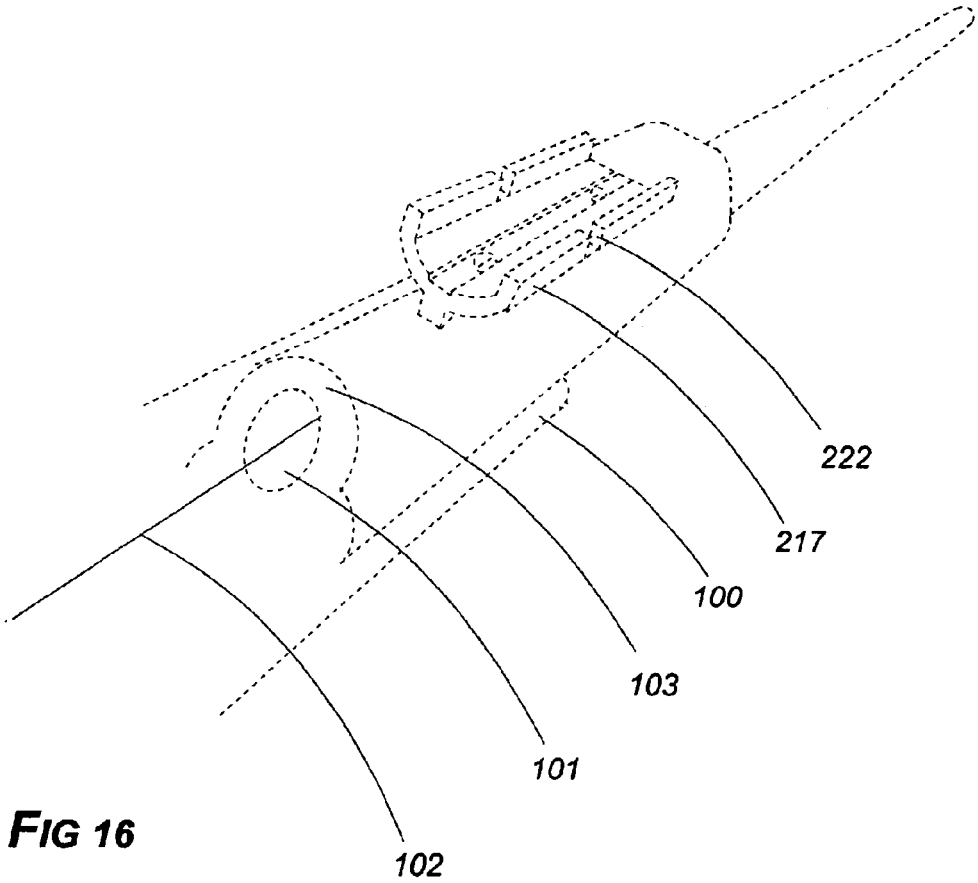
FIGS. 16 and 17 illustrate the scope cradle (217) and related mounting components for a typical scope (200) and firearm assembly.
Figure 17:
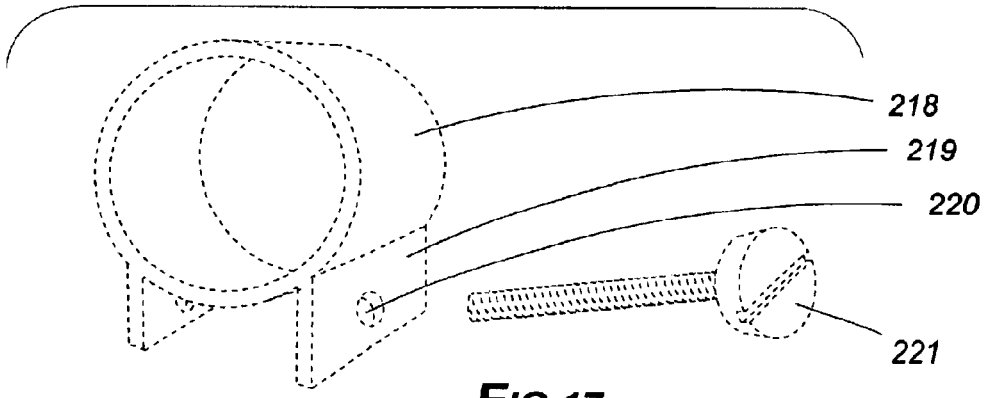
Figure 18:
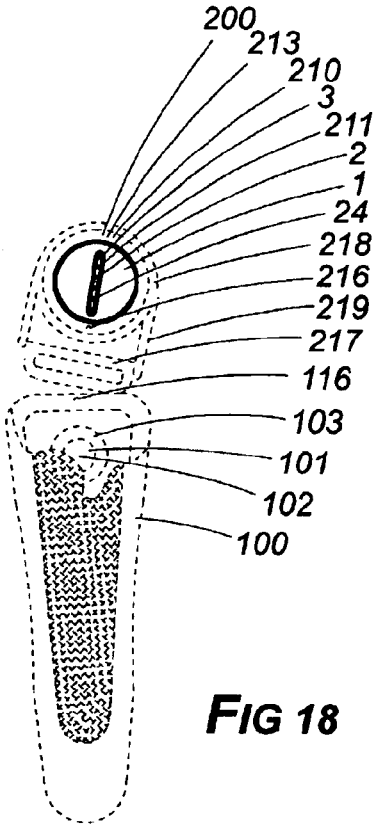
FIGS. 18–20 illustrate how, as addressed supra, directional indicator indicia (3) simultaneously aligned to both a scope alignment reference (210) and a firearm alignment reference (116) in turn itself (116) in true vertical alignment with the firearm bore's center (102) can be, nevertheless, out of alignment with the bore's center (102), disposing the scope (200) and barrel (103) in a canted relationship. As shown, the firearm alignment reference (116) is a mere point or dot in FIGS. 18 and 19. However, as shown in FIG. 20, where the firearm alignment reference (116) is a linear one (116), true alignment between the indicia (3) and the bore's center (102) is assured.
Figure 19:
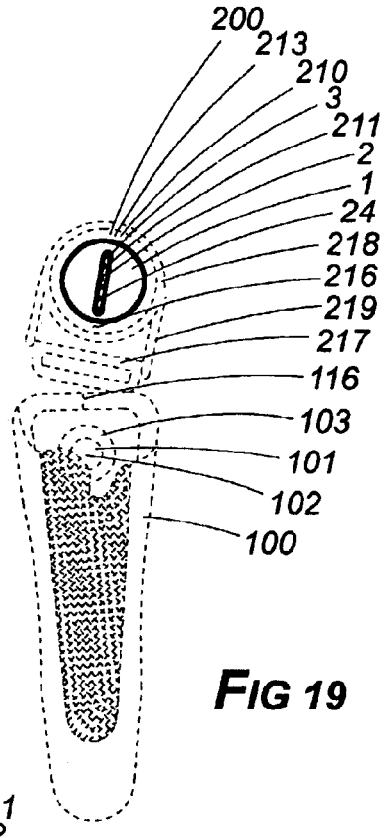
Figure 20:
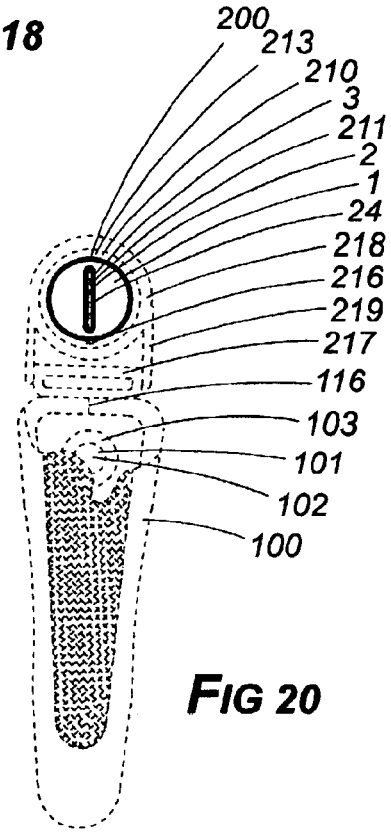
Figure 21:
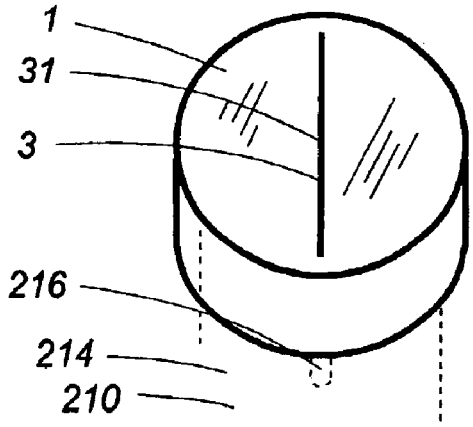
FIGS. 21–23 comprise embodiments illustrating how alignment between the cap's directional indicator indicia (3) and the scope's alignment reference (216) is made possible. Since, as explained supra, the reference's (216) alignment with the scope's reticulate components (210) is inherent—having been assured in manufacture—the indicator indicia's (3) alignment with the reticulation (210) may be relied upon.

The subject of this application comprises an aligning cap (1) which together with other features addressed herein comprises a scope-to-firearm alignment tool. It is a simple mechanism instrumental in determining how much a sighting scope (200) should be adjusted to reset it (200) so that its reticulate components (210) become aligned with the firearm bore's center (102). Most importantly, it circumvents the problem that an operator cannot simultaneously see both the scope's reticulate components (210) and the firearm bore's center (102) or even a alignment reference (116) on the exterior of the firearm body (100). The adjustments involved are considered in a general way to be workbench alignments, although they may be just as successfully performed in the field.

Except for the features otherwise provided for herein, the cap (1) may resemble a removable eyepiece of the sort often seen on cameras or telescope assemblies in general, requiring height or thickness sufficient merely to enclose reticulate means (2)—cross-hairs and the like, ante, when they (2) are internally disposed, and to permit the emplacement—that is, its (1) connection (4) to either of the scope ends (213, 214).

In using the invention, it is first assured in general that either certain indicia (3), ante, on the cap (1) is aligned, indirectly, supra, with the scope's reticulate components (210) or that the cap's reticulate means (2) is aligned directly to them (210). Then, the scope (200) and cap (1) together are rotated to align the indicia (3), either directly or indirectly, supra, also with the firearm bore's center (102).

The cap's indicia (3) referred to supra is more specifically designated herein as directional indicator indicia (3). This element (3) may take any of several forms. It (3) is always disposed externally to the scope (200)—that is, it (3) can be clearly seen without peering into the scope (200). In plain sight, as it (3) is, it is a simple undertaking to align it (3) with either a firearm alignment reference (116)—preferably a linear one, supra—or a scope alignment reference (216); or for that matter, directly with the bore center itself (121) when open to view, supra. In all three cases the indicator indicia (3) and the respective reference (116, 216) or exposed bore center (102), all comprising suitable objects of reference, can be observed at the same time and without peering into the scope (200).

The directional indicator indicia (3) may comprise nothing more than a straight printed line or other mark (31) inscribed upon the cap (1). Such an inscription (31), defined supra, preferably ends near enough the edge of the cap (1) to permit convenient comparison with the other objects of alignment, supra. While, a printed line may comprise the simplest sort of inscription (31), a groove or embossment is less likely to be worn away in use.

The indicator indicia (3) may otherwise comprise an externally disposed alignment pointer array (32), ante.

For connection, the aligning cap (1) comprises, among other things, what is designated herein as rotable scope emplacement means (4) configured to dispose the cap (1) for viewing purposes coaxially upon either of the scope's ends (213, 214). Once the cap (1) is in place, either its reticulate means (2) or its directional indicator indicia (3) or both (2, 3), ante, may be employed for alignment purposes.

Figure 45:
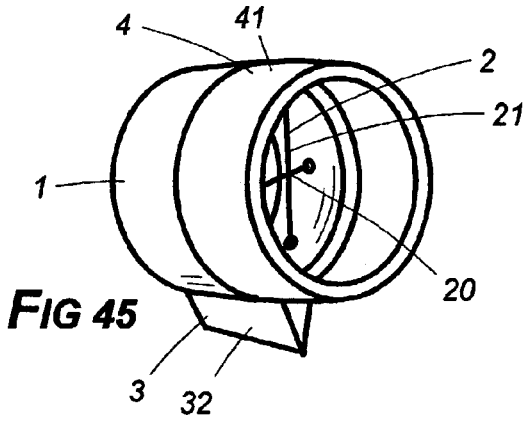
FIGS. 45–49 illustrate embodiments of the invention, each comprising a particular type of rotable scope emplacement means (4). That (4) of FIG. 45 is an elastic sleeve (41) of size to fit snugly over the end of the scope (200) but which (41), nevertheless, permits operable rotation upon it (200) for sighting adjustment. That (4) of FIG. 46 is a multiply slitted tensioned sleeve (42) of durable material comprising less flexibility than that of the elastic sleeve (41) but which by reason of its (4) configuration, nonetheless, is held rotably in place by the tensioned compression of the slitted end. That (4) of FIG. 47 comprises tensioned extending fingers (43) which by reason of their (43) configuration function much in the way of the tensioned sleeve (42), supra. Finally, those (4) of FIGS. 48 and 49 are assemblies comprising interconnecting threads (44), an arrangement discussed ante. The threads of the former are internally disposed, those of the latter, externally so. Ridge and channel configuration (45) rotable means, ante, are also shown to be present. All five embodiments are shown to have solid strand reticulate means (21).
Figure 46:
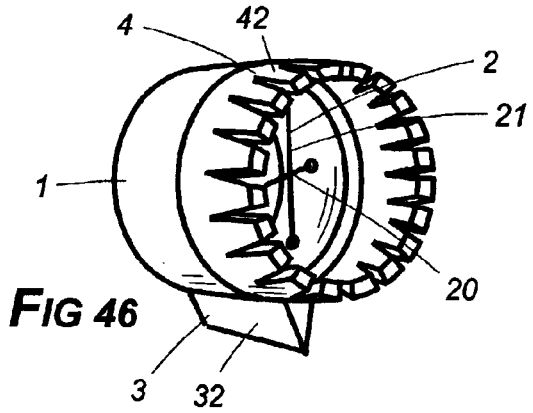
Figure 47:
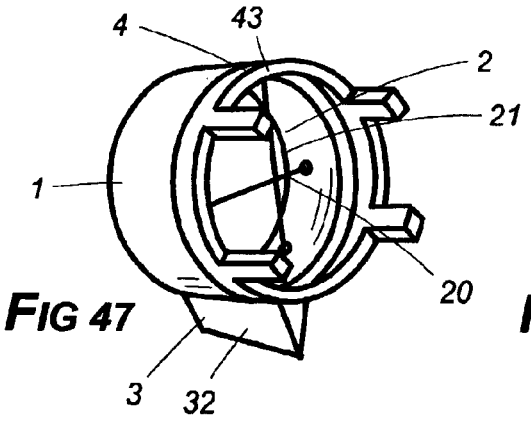

The emplacement means (4) may comprise any one of several configurations known to the art. It (4) may, for example, comprise tensional members of hard plastic which snap in place, having either a multiply slitted connecting configuration (42) or an extending compression fingered one (43). The means (4) may comprise an elastic sleeve (41)—that is, a rubber-like snugging ring as in FIG. 45—which the operator merely slides over either of the scope's ends (213, 214) where (213, 214) by reason of its (41) elasticity or resilience, it (41) remains firmly in place until pulled off. The elastic sleeve (41) is configured with a wall of inner diameter to snugly fit the outer diameter of the particular end (213, 214) of emplacement. The fit—snug as it is—is, nonetheless, just loose enough to permit the cap's (1) rotation about the scope's (200) longitudinal axis. In FIGS. 1 and 24–27, where disposition is upon the scope's ocular end (213), it is that configuration (41) which comprises the necessary rotable scope emplacement means (4). It (41) is the simpler and most preferred of all embodiments thereof (4).

Figure 48:
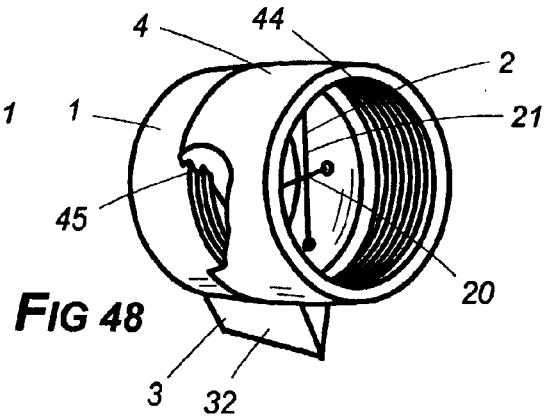
Figure 49:
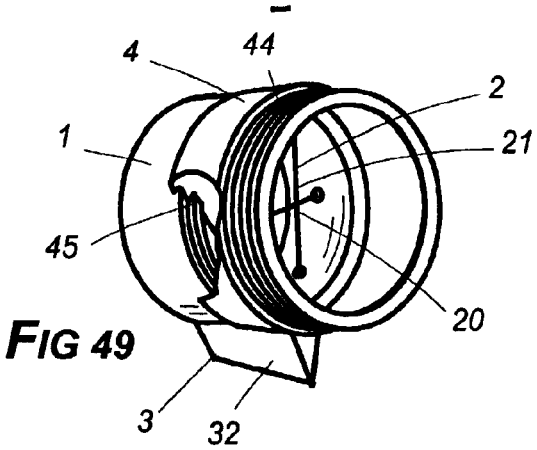
Figure 50:
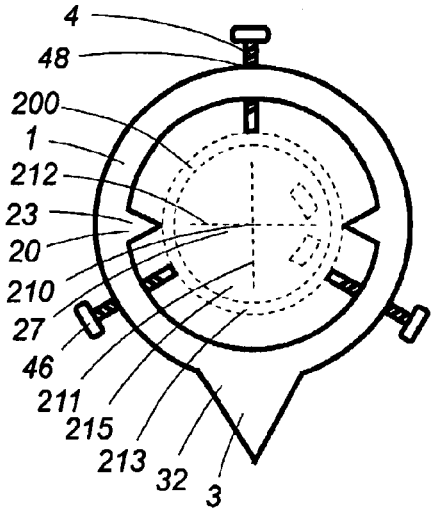
FIGS. 50–53 are structural variations of size disparity adjustment means illustrating the impingement of set screws (46) against a scope (200). In the first two depictions, three set screws (46) are disposed for balanced adjustment. In the latter of these two, the disposition is more favorable to screw-driver access, better avoiding any obstruction the underlying firearm stock or body (100) might present. In the last two of the four, a retention spring (47) is incorporated beneath the scope (200), which thereby becomes seated upon and impinged against it (47) for adjustment. These features permit fitting the invention to scopes (200) of differing diametric size or even to either of a given scope's ends (213, 214) comprising diameters different from one another (213, 214).
Figure 51:
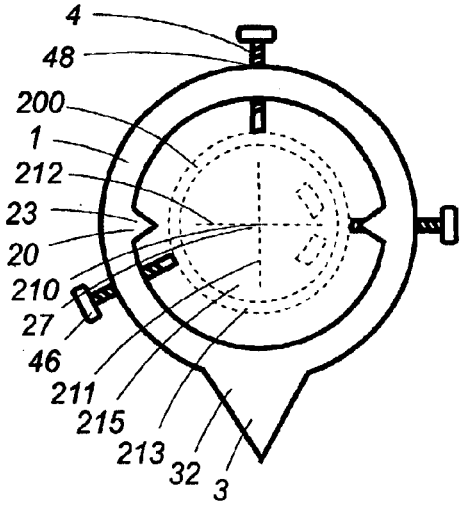
Figure 52:
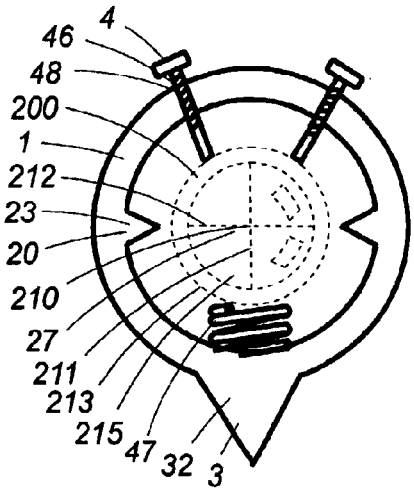
Figure 53:
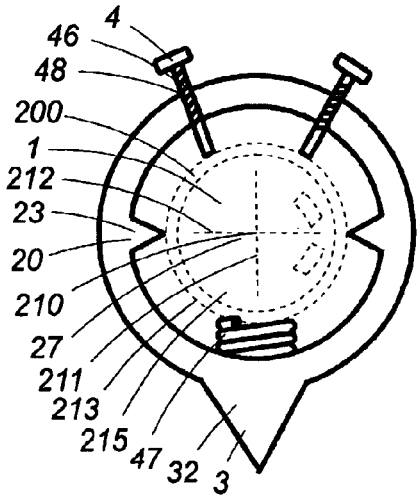

The emplacement means (4) may otherwise take the form of interconnecting threads (44). Either externally or internally disposed cap (1) threading mated to that usually present at the scope ends (213, 214) is feasible. Because many scopes (200) presently comprise threading disposed at each end (213, 214) the cap's (1) threads may be made to coengage, the latter is preferred. Additional rotable means such as the ridge and channel configuration (45) shown in FIGS. 48 and 49 is preferred to avoid disturbing the threaded juncture upon rotating the cap (1) for alignment to the scope's reticulate components (210).

In addition to the indicator indicia (3) and the rotable scope emplacement means (4), the cap (1) also preferably comprises inherent reticulate means (2) enabling direct alignment between the cap's reticulate means (2) and the scope's reticulate components (210). When present, the reticulate means (2) may take any one of several forms, comprising either vertically or horizontally oriented aspects or both which may be lined up respectively with the vertical (211) or horizontal (212) members of the scope's reticulate components (210).

Reticulate means (2), supra, may comprise either a doubly oriented configuration—that is, a crossed one, preferably orthogonally so (20); or a singularly oriented reference (22). The former (20) of the two (20, 22) is, of course, by far the more popular and a preferred version of such means (2).

Moreover, the means (2) may comprise in (2) substance one or more solid strands (21) of wire or other similar material suitable for displaying one or more hairline references; one or more viewing slits (24)—narrow openings to peer through; a series or pattern of aligned apertures (28); or opposing circumferential indicia (23), all of which are further discussed ante.

As suggested, supra, the aligning cap's directional indicator indicia (3) may comprise an externally disposed alignment pointer array (32). The array (32) is preferably made to project outward from the cap's (1) circumference and configured triangularly or in arrowhead-like fashion, presenting an easily visualized outwardly pointing apex as a directional indicator. To control the array's (32) orientation, it is merely necessary to rotate the cap (1) upon the scope (200). It (1) should be carefully turned to cause a member of the array (32) to point directly at a firearm alignment reference (116) or the firearm bore's center (102) if exposed to view.

With a pointer array (32) large enough to be readily observable—there is always the matter of space or clearance to consider. Configured too long in extension, it would encounter obstruction with some portion of the firearm's body (100) during rotational positioning. If too short, on the other hand, it may be difficult to ascertain precisely what it (32) is pointing at, making it (32) very difficult to line up with the object of alignment (102, 116).

The cap (1) may, accordingly, be configured with a pointer array (32) comprising a series of circumferential pointing indexes (51–54) differing from one another (51–54) in size from which the operator may make a selection. In such an arrangement, an aligning cap (1) comprising four such indexes (51–54) spaced around its (1) circumference comprises a shortest (51), first intermediate size (52), second intermediate size (53) and longest alignment index (54) in keeping with its (51, 52, 53, 54, respectively) size. Thus, if the longest thereof (54) or another of considerable length such as (53) cannot be brought into desired pointing relationship with an object of alignment (102, 116), it should be possible to rotate a shorter one (51–53 or 51, 52, respectively) into place. The indexes (51–54) should be of size such that at least one of them (51–54) can be made true with an object of alignment without encountering obstruction.

Figure 30:
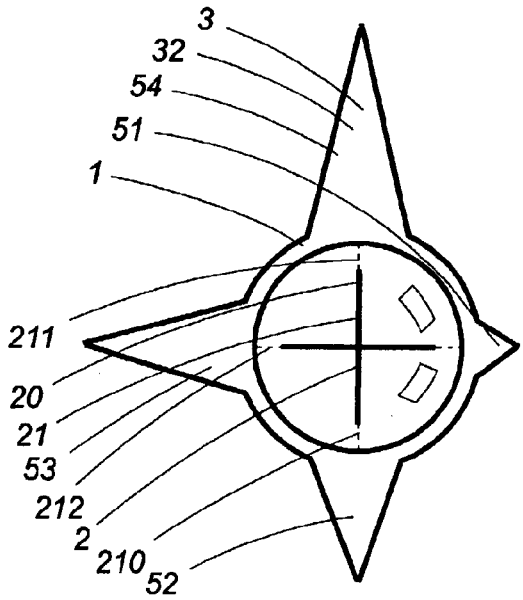
Figure 31:
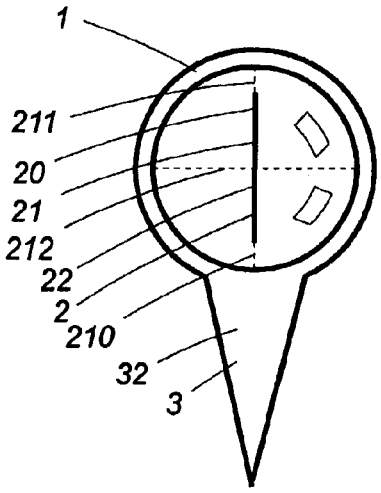
FIGS. 31–34 represent aligning caps (1) comprising singularly configured orientation references (22) for which solid strand reticulate means (21) are again provided—vertical in two cases, horizontal in the remaining two.
Figure 32:
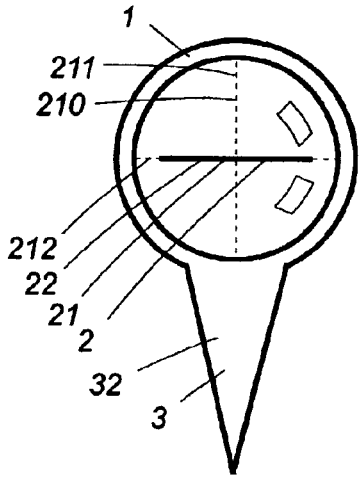
Figure 33:
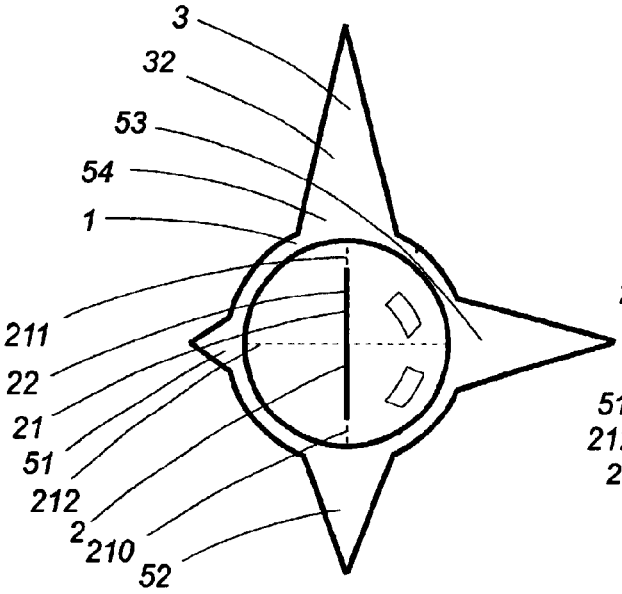
Figure 34:
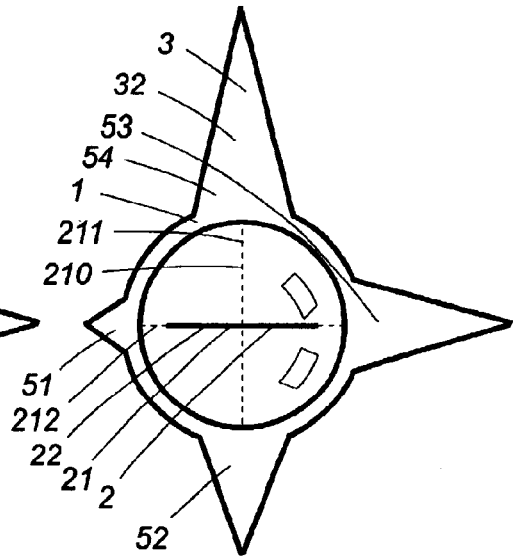
Figure 35:
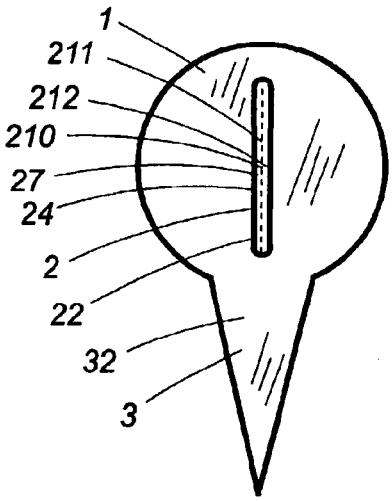
FIGS. 35–38 illustrate caps (1) also comprising singular orientation references (22), all (22) of the open slit (24) variety—two of the references (22) disposed vertically and two, horizontally.
Figure 36:
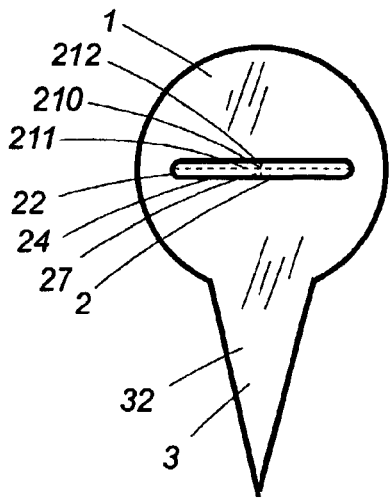
Figure 37:
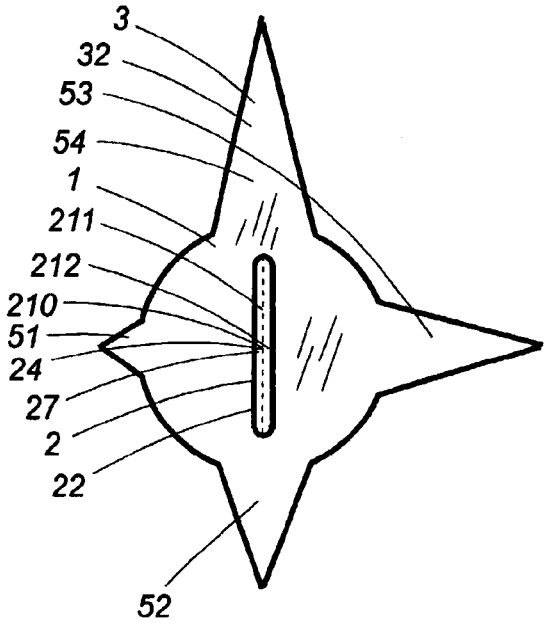
Figure 38:
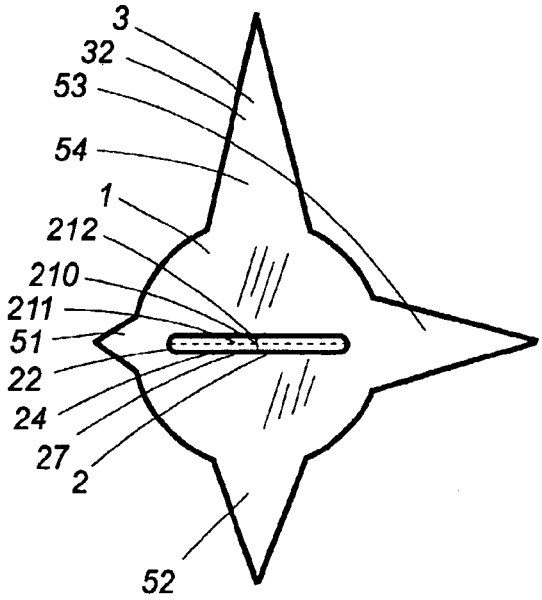
Figure 39:
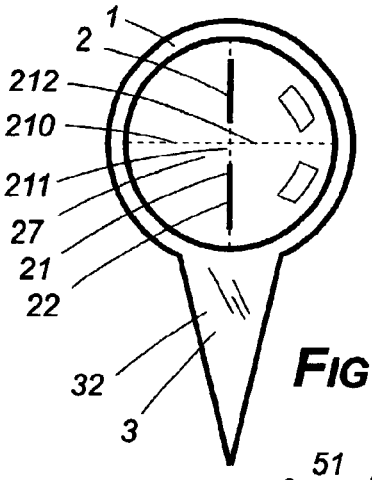
FIGS. 39–44 disclose views of caps (1) in which open centered references of one sort or another (27) are present so that the center of the scope's reticulate components (210) can be seen when sighting for alignment. Among the variations.
Figure 40:
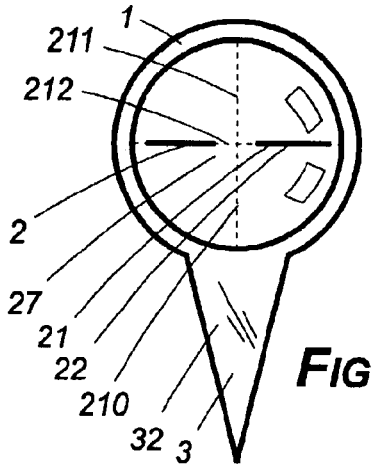
Figure 41:
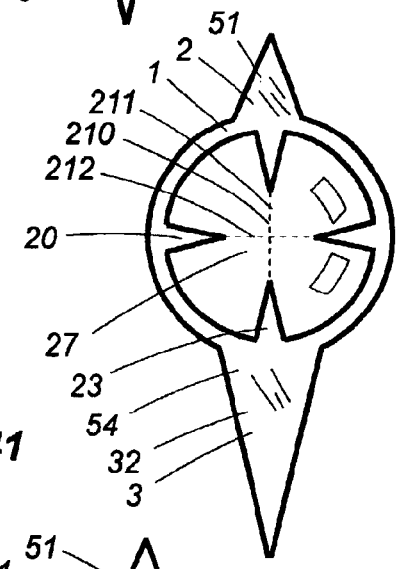
Figure 42:
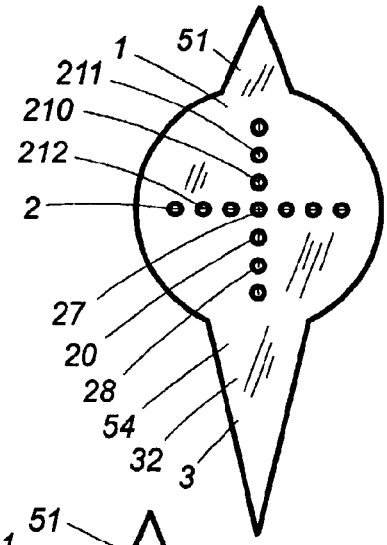
Figure 43:
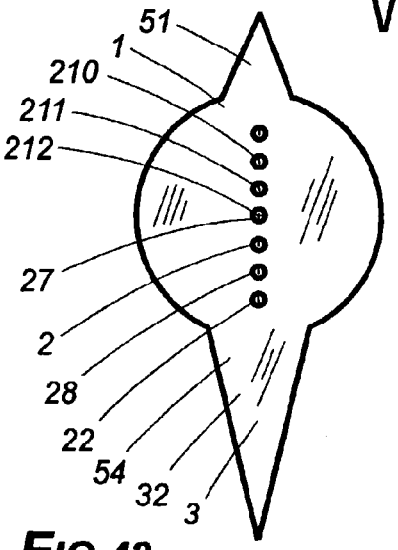
Figure 44:
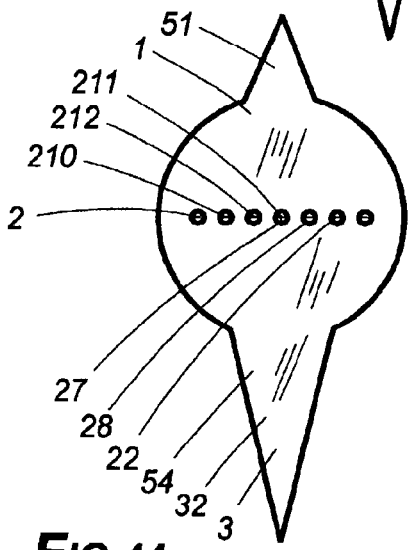

As a corollary to this scheme, it is advantageous to assure that the pointing indexes (51–54) be disposed by size in rotational sequence—that is, that a sequential order of arrangement be disposed in either clockwise or counterclockwise fashion—shortest (51), first intermediate size (52), second intermediate size (53) and then longest (54). This disposition, which may be otherwise properly characterized as one of circumferential progression, facilitates unobstructed rotation of the cap (1) to avoid having any of the shorter indexes (51, 52 or 53) blocked by an obstruction to the cap's (1) complete rotation. FIGS. 29, 33, 34, 37 and 38 illustrate caps (1) which permit unrestricted clockwise rotation away from too long an index (53 or 54, for example); FIGS. 1 and 30, those permitting it in a counterclockwise manner.

Since for proper alignment, the scope's reticulate components (210) must be aligned with the cap's pointer array (32), it is convenient if the maximum number of pointing indexes (51–54) is four—one (51–54) for each opposing end of the scope's reticulate components (210) present, whether vertical (211), horizontal (212) or both (211, 212). Such is, therefore, the preferred arrangement.

Conferring the reticulate means (2) with one or more viewing slits (24) avoids obscuring the scope's reticulate components (210) situated distally within the scope (200). Slitted examples (24) given in FIGS. 1, 18–20, 25 and 35–38 include both orthogonal (20) and singular references (22).

Another suitable variation in look-through reticulate means (2) comprises what is defined herein as an open centered reference (27), wherein solid strand (21) or other indicia (2), including either the singular (22) or the orthogonal (20), have the center portion removed so that the center of the scope reticulate components (210) is not obscured from viewing. An arrangement of viewing slits (24) referred to supra comprises another example of an open centered reference (27).

The aligned apertures (28), supra, may be configured as circles or other shapes which (28) may be very tiny as in FIGS. 27 and 42–44 but may nevertheless, as shown therein, also provide an open centered reference (27).

The circumferentially arranged geometric shapes, supra—small triangles, diamond shapes and the like, designated herein as circumferential sighting cues (23) for which examples are shown in FIGS. 26, 41 and 50–53—may be oppositely disposed as substitutes for the solid strand (21) or other members and, therefore, comprise an additional type of an open centered reference (27).

A cap's reticulate means (2) can be configured to double also as its directional indicator indicia (3). Reticulate means (2) providing look-through characteristics including circumferential sighting cues (23), slits (24), open centered references (27) or aligned apertures (28) also comprise indicator indicia (3) by reason of their configuration. The elongation of the slits (24), for example, is not unlike that of an inscribed line (31). While an operator may not view the interior of the scope (200) through indicia (3) comprising an inscription (31), he or she may peer through a slit (24) for alignment with the reticular components (210) therein (200). The same follows for the others (23, 27, 28). They all may be employed as pointers indicating the direction toward an object of alignment.

Figure 22:
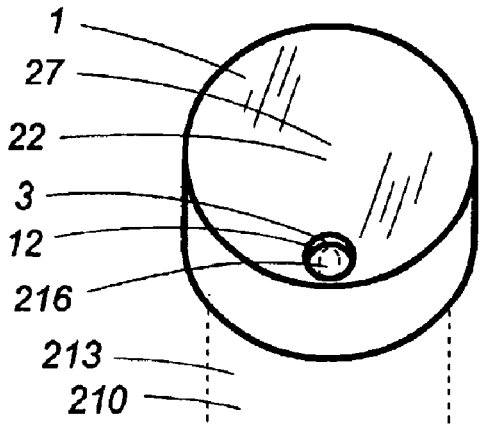
Figure 23:
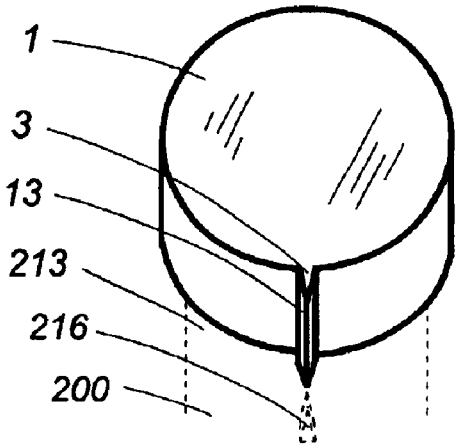
Figure 24:
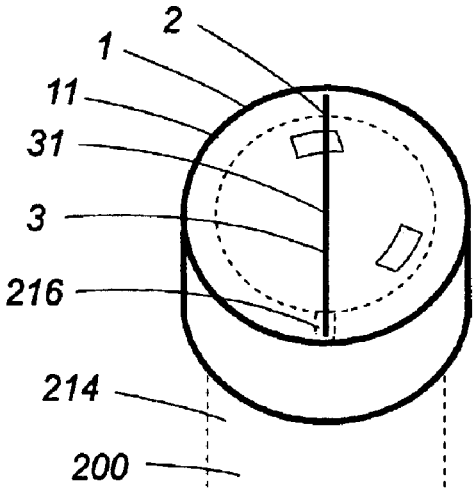
FIGS. 24–27 are also models demonstrating alignment between the cap's directional indicator indicia (3) and the scope's alignment reference (216). In these drawings, both the reticulate means (2) and the indicia (3) are comprised by the same structure.
Figure 25:
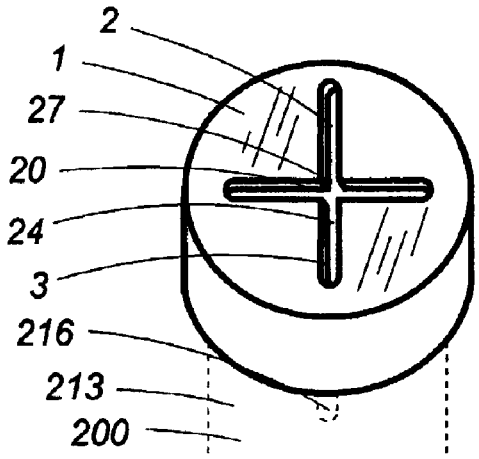
Figure 26:
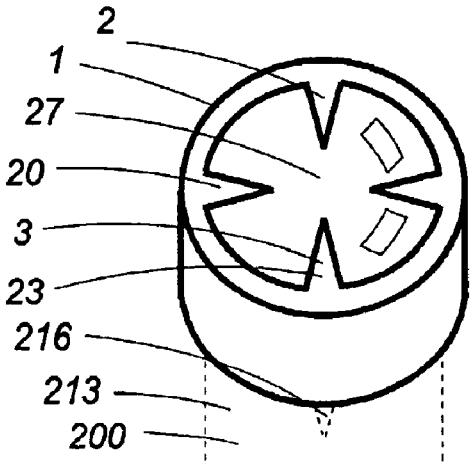
Figure 27:
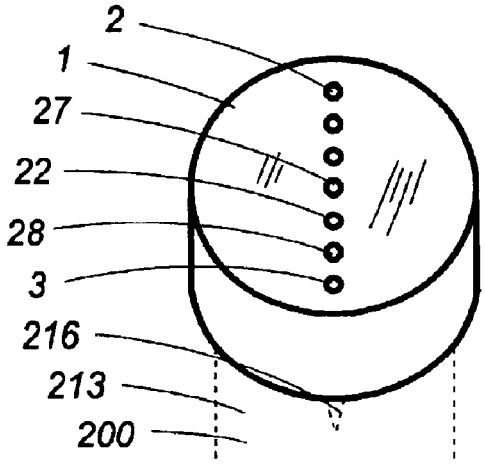
Figure 28:
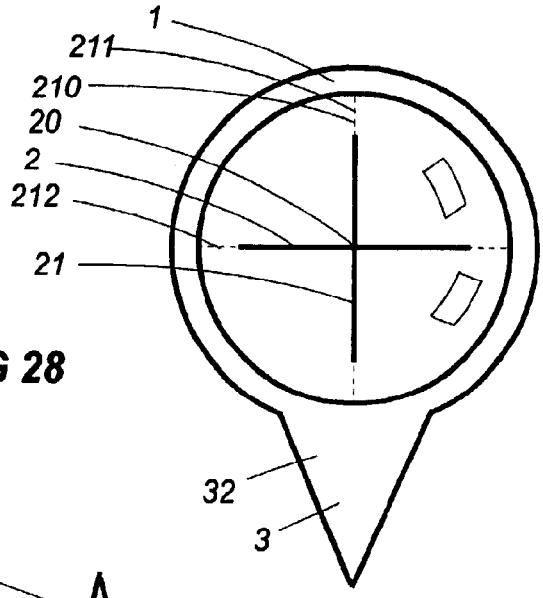
FIGS. 28–30 feature aligning caps (1) with various externally disposed alignment pointer arrays (3). The cap (1) of FIG. 28 comprises but a singular member in its array (3); that (1) of FIG. 29, a sequential counterclockwise arrangement of four pointing indexes of successively increasing size (51–54, respectively); and that (1) of FIG. 30, a clockwise disposition (51–54, respectively). In all three depictions, orthogonally configured references (20) comprising solid strand reticulate means (21) are provided.
Figure 29:
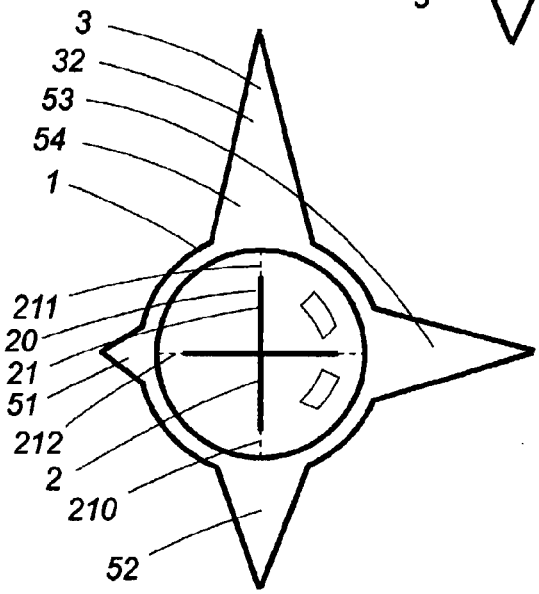

If the cap (1) is fashioned to comprise transparent composition (11), one may look down the scope (200) for alignment even with an inscribed line. FIG. 22 illustrates such configuration. Other schemes in which reticulate means (2) may serve also as indicator indicia (3) include disposing a viewing aperture (12) in the cap (1) through which the alignment reference (216) may be seen, as in FIG. 23. It is also feasible to configure the cap (1) so a singular membered externally disposed pointer array (32) thereon may be lined up with a similarly shaped embossment on the scope (200) much like the pop-open indices observed on most pill bottle closures, as shown in FIG. 27.

Because a sighting scope's ocular end (213) may be expected to comprise diameter different than its objective end (214), supra, and one scope (200) may be expected to vary in diameter from another, accommodating variations in the aligning cap's (1) configuration are feasible. One embodiment of the cap (1), therefore, comprises disposed around its (1) circumference a plurality of—at least two, preferably three—threaded apertures (48) through which set screws (46) may be interthreaded or driven. Upon advancement through the apertures (48) and consequent penetration through into the cap's (1) interior, they (46) contact the scope (200) for central positioning more or less in the way the screws of a porch-light's frame retain the light's globe in place. If a retention spring (47) is also disposed within the assembly, only two set screws (46) are required in that they (46) may be positioned to impinge the scope (200) against the spring (47). Collectively, these accommodating variations, illustrated in FIGS. 50–53, are herein designated size disparity adjustment means and the connection may properly be said to qualify as one of rigid emplacement.

Without more, rotation of the scope (200) for workbench sighting alignment would require that the screws (46) be temporarily loosened. Therefore, it is preferred that the additional rotable means (45) addressed supra in connection with the aligning cap's (1) interconnecting threaded emplacement means (44) be included also as part of this embodiment's structure.

The foregoing considerations lend themselves to an innovative methodology of the sort which might be outlined in a novel process of aligning the scope's reticulate components (210) with the firearm bore's center (102). A first method of doing so is expressed in the following steps: One first emplaces the aligning cap (1) coaxially upon one of the scope's ends (213, 214); then brings the cap's indicator indicia (3) into referential alignment with the scope's reticulate components (210); and then finally rotates the scope (200) together with the cap (1) to bring the indicator indicia (3) either into referential alignment with a firearm bore's center (102) or into direct alignment with a firearm bore's center (102) open to view.

A second method dedicated to that same end is expressed in the following steps: One first emplaces the aligning cap (1) coaxially upon one of the scope's ends (213, 214); then, by peering down the scope (200), brings the cap's inherent reticulate means (2) into direct alignment with the scope's reticulate components (210); and then finally rotates the scope (200) together with the cap (1) to bring the indicator indicia (3) either into referential alignment with a firearm bore's center (102) or direct alignment with a firearm bore's center (102) open to view.

The inventor hereby claims:

1. A scope-to-firearm alignment assembly comprising an aligning cap comprising in turn rotable scope emplacement means configured to dispose the aligning cap coaxially upon a firearm scope at one of: its ocular end; and its objective end;

the aligning cap further comprising directional indicator indicia disposed to be operably brought into referential alignment with the scope's reticulate components, direct alignment with the center of a firearm bore open to view and referential alignment with the center of one which is not;

whereby a canted scope may be correctively reset into alignment with the firearm bore's center.

2. The scope-to-firearm alignment assembly according to claim 1 wherein the aligning cap's directional indicator indicia comprises an inscription.

3. The scope-to-firearm alignment assembly according to claim 1 wherein the aligning cap's directional indicator indicia comprises an alignment pointer array comprising one or more pointing indexes.

4. The scope-to-firearm alignment assembly according to claim 1 wherein the aligning cap further comprises inherent reticulate means disposed in alignment with the directional indicator indicia thereon and further disposed for adjustable direct viewing alignment to the scope's reticulate components;

whereby alignment accuracy may be assured.

5. The scope-to-firearm alignment assembly according to claim 1 wherein the aligning cap's rotable scope emplacement means comprises an elastic sleeve configured with a wall of inner diameter to snugly fit the outer diameter of either of the scope's ends.

6. The scope-to-firearm alignment assembly according to claim 1 wherein the aligning cap's rotable scope emplacement means comprises a multiply slitted tensioned sleeve configured with a wall of inner diameter to snugly fit the outer diameter of the scope's ocular or objective end.

7. The scope-to-firearm alignment assembly according to claim 1 wherein the aligning cap's rotable scope emplacement means comprises interconnecting threads configured to interthread with mated threads disposed at the scope's ocular or objective end.

8. The scope-to-firearm alignment assembly according to claim 1 wherein the aligning cap's rotable scope emplacement means comprises size disparity adjustment means;

whereby the aligning cap may be fitted to a scope end of any diametric size not greater than the cap's inner diameter.

9. The scope-to-firearm alignment assembly according to claim 3 wherein the alignment pointer array comprises first, second, third and fourth alignment pointing indexes wherein the first comprises the longest thereof; the second, the shortest; and the third and fourth are of intermediate size, the fourth comprising greater length than the third; and wherein each index is disposed in referential alignment with the alignment cap's reticulate means; whereby at least one index can be brought into alignment with the firearm bore's center or a firearm alignment reference without encountering obstruction.

10. The scope-to-firearm alignment assembly according to claim 4 wherein the inherent reticulate means comprises the directional indicator indicia itself.

11. The scope-to-firearm alignment assembly according to claim 4 wherein the reticulate means comprises an orthogonal reference.

12. The scope-to-firearm alignment assembly according to claim 4 wherein the reticulate means comprises one or more slits through which scope's reticulate components are observable when aligned thereto.

13. The scope-to-firearm alignment assembly according to claim 4 wherein the reticulate means comprises an open center.

14. The scope-to-firearm alignment assembly according to claim 4 wherein the reticulate means comprises a singular reference disposed such that the scope's reticulate components may be operably adjusted for viewing alignment with it.

15. The scope-to-firearm alignment assembly according to claim 8 wherein the size disparity adjustment means comprises a plurality of circumferentially arranged set screws and threaded apertures disposed such that, upon advancement through the apertures, the screws are caused to contact the scope for central positioning adjustment;

whereby the aligning cap may be fitted to a scope of any diametric size not greater than the cap's inner diameter.

16. The scope-to-firearm alignment assembly according to claim 10 wherein the reticulate means comprises aligned apertures.

17. The scope-to-firearm alignment assembly according to claim 13 wherein the open centered reticulate means comprises circumferential sighting cues.

18. The scope-to-firearm alignment assembly according to claim 15 wherein the size disparity adjustment means further comprises a retention spring disposed such that by reason of the screw's contact, the scope is impinged against the spring, further facilitating the scope's central positioning adjustment.

19. A method of aligning firearm scope reticulate components to a firearm bore's center comprising the following steps:

first, emplace coaxially upon either the ocular or objective end of a firearm scope a cap comprising directional indicator indicia;

second, align the indicator indicia with a scope alignment reference;

third, rotate the scope and cap together to align the cap's indicator indicia with either the center of a firearm bore open to view or a firearm alignment reference;

whereby alignment of the scope's reticulate components with the bore's center is assured.

20. A method of aligning firearm scope reticulate components to a firearm bore's center comprising the following steps:

first, emplace coaxially upon either the ocular or objective end of a firearm scope a cap comprising both inherent reticulate means and directional indicator indicia;

second, align the cap's reticulate means with the scope's reticulate components;

third, rotate the scope and cap together to align the cap's indicator indicia with either the center of a firearm bore open to view or a firearm alignment reference;

whereby alignment of the scope's reticulate components with the bore's center is equally assured.

* * * * *